United States Patent [19]

Kühn

[11] Patent Number: 4,724,970

[45] Date of Patent: Feb. 16, 1988

[54] COMPENSATING DEVICE FOR A CRANE HOOK

[75] Inventor: Hans Kühn, Hamburg, Fed. Rep. of Germany

[73] Assignee: Bomag-Menck GmbH, Boppard, Fed. Rep. of Germany

[21] Appl. No.: 944,857

[22] Filed: Dec. 22, 1986

[30] Foreign Application Priority Data

Dec. 28, 1985 [DE] Fed. Rep. of Germany ..... 3546277

[51] Int. Cl.[4] ..... B66C 23/53

[52] U.S. Cl. ..... 212/147; 212/191; 254/277

[58] Field of Search ..... 212/146, 147, 191; 254/277, 900; 414/138

[56] References Cited

U.S. PATENT DOCUMENTS

| | | | |
|---|---|---|---|
| 3,365,075 | 1/1968 | van Gils et al. | 212/146 |
| 4,025,055 | 5/1977 | Strolenberg | 212/191 |
| 4,155,538 | 5/1979 | Claassen | 212/146 |
| 4,395,178 | 7/1983 | MacDonell et al. | 212/146 |

FOREIGN PATENT DOCUMENTS 2390365 12/1978 France .

2494244 5/1982 France .

*Primary Examiner*—Joseph F. Peters, Jr.
*Assistant Examiner*—Stephen P. Avila
*Attorney, Agent, or Firm*—Michael J. Striker

[57] ABSTRACT

A compensating device for avoiding swell-generated relative movements between a load suspended on a crane and a load placing surface, or between a crane hook and a load to be carried thereby, the compensating device comprises a hydraulic cylinder-piston unit including a cylinder with an inner space, a piston sealingly displaceable in the cylinder and subdividing the inner space into a load supporting chamber which is to be filled in operation with hydraulic liquid and a second chamber, a piston rod connected with the piston, and a hydraulic accumulator connected with the supporting chamber and accommodating a pretensioned gas cushion, the second chamber being filled in operation with hydraulic liquid, the hydraulic accumulator including at least one hydraulic accumulating element which is connected with the second chamber and accommodating a gas cushion with a low pressure, the piston rod extending through both the load supporting chamber and the second chamber and extending outwardly beyond end surfaces of the cylinder.

18 Claims, 8 Drawing Figures

COMPENSATING DEVICE FOR A CRANE HOOK

BACKGROUND OF THE INVENTION

The present invention relates to a compensating device for reducing relative movements between a load suspended from a crane and a load placing surface, or crane hook and a load to be carried, generated by swell.

Devices of the above mentioned general type are known in the art. A known device has a hydraulic cylinder-piston unit which is to be connected with a crane hook or a load and has a cylinder, a piston which sealingly displaces in the cylinder and subdivides it into a load supporting chamber arranged to be filled in operation with hydraulic liquid and a second chamber, and a piston rod which is connectable with the load or the crane hook and sealingly extends from the load supporting chamber, and a hydraulic accumulator connected with the load supporting chamber for accommodating a pretensioned gas cushion. During erecting of marine structures, especially for erecting or anchoring drilling islands or the like in open sea, high and heavy structures are to be lowered by expensive working ships with big cranes of high carrying capacity. The structures have to be taken from fixed or swimming bases and placed on highly raised drilling islands or to increased water depths. Irregular movements of working ships, pontoons or supply ships generated by swell, wind etc., are increased so much with great dimensions of the used crane beam, that even with average swell it is difficult or impossible to carry by the crane sensitive structures during violent ship and crane movements and to lower them in this condition to great depths. Since daily costs of operation with working ships are very high, each disturbance of works causes enormous additional costs. Therefore a strong demand exists to perform respective works also in less favorable weather and with average swell without damaging the structures to be moved.

In the known compensating device of the above mentioned type, the cooperation of the hydraulic cylinder-piston unit and the hydraulic accumulator connected with the chamber to be acted by the load provides a spring action which supports the load. Each intentional or unintentional placing of the load onto a supporting surface, because of the quick unloading of the hydraulic liquid in the loading supporting chamber, leads to a very violent relative movement of the piston and hydraulic cylinder which can easily lead to damages or destruction of seals or respective parts in the compensating device.

Moreover, the known devices are not suitable for placing structural elements to conventional great water depths of 300–800 meters, since in such depths the extension of the piston rod is counteracted by high pressure which corresponds to its cross section and increases with lowering of the load. As a result of this, the springy action as well as the speed of the action is affected, so that short-time dangerously high impact forces can be generated, especially when the load is connected with the crane by long supporting elements.

SUMMARY OF THE INVENTION

Accordingly, it is an object of the present invention to provide a compensating device of the above mentioned general type, which avoids the disadvantages of the prior art.

More particularly, it is an object of the present invention to provide a compensating device of the above mentioned general type, in which simple means provide in condition of considerable swell and high working depths, a fast and effective damping of undesirable relative movements between the load and the supporting surfaces or crane hooks.

In keeping with these objects and with others which will become apparent hereinafter, one feature of the present invention resides, briefly stated, in a compensating device for reducing relative movements between a load suspended on a crane and a load placing surface, or a crane hook and a load to be carried, which includes a hydraulic cylinder-piston unit with a cylinder, a piston which sealingly displaces in the cylinder and subdivides it into a load supporting chamber arranged to be filled in operation with hydraulic liquid and a second chamber, a piston rod connected with the piston and extending in a sealing manner from the load supporting chamber with means for connecting it to the load or the crane hook, at least one hydraulic accumulator connected with the load supporting chamber and having a pretensioned gas cushion, wherein the second chamber in operation is filled with hydraulic liquid, at least one further hydraulic accumulator is connected with the second chamber and is provided for receiving a gas cushion pretensioned to a lower pressure, and the piston rod extends through both chambers of the cylinder and projects outwardly through end surfaces in a sealing manner.

This compensating device has a construction which is relatively simple and inexpensive, and at the same time provides for effective automatic compensation of undesirable relative movements in great depths. The device can be adjusted in an optimum manner in dependence upon the type and the weight of the structures to be moved, the use over or underwater, and the working depths, in a very simple manner by a respective adjustment of the gas pressure in the hydraulic accumulator. The design and arrangement of the hydraulic accumulator on the hydraulic cylinder-piston unit can be adapted to the requirements of especially narrow and especially short structures.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF PREFERRED EMBODIMENTS

Figure 1:
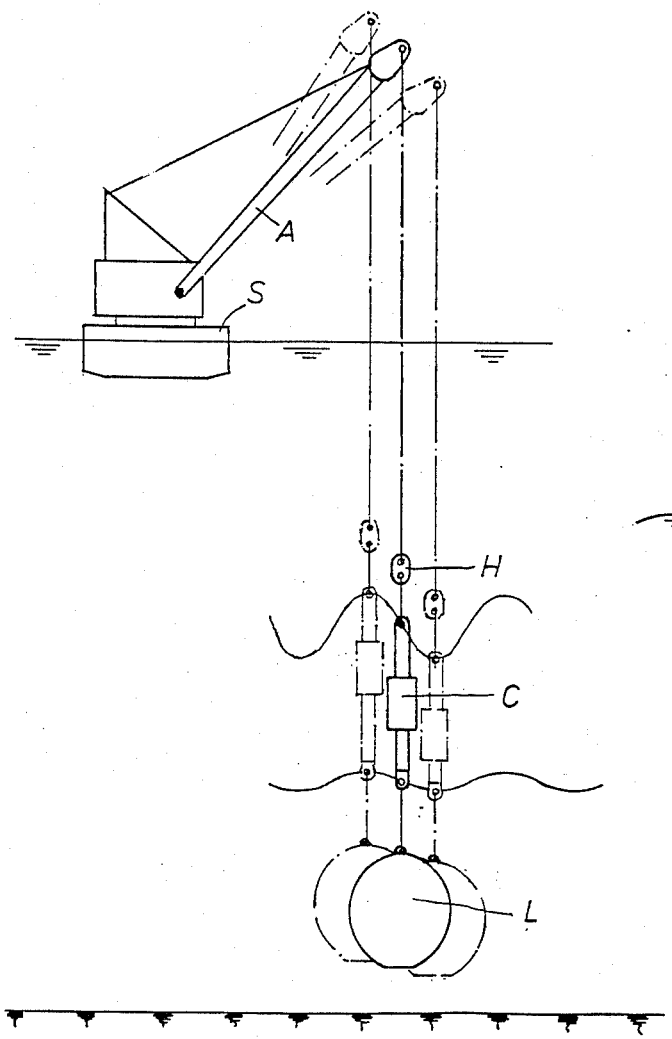
FIG. 1 is a schematic view showing a load to be lowered from a crane ship by means of a compensator.

As shown in FIG. 1, a jib crane A is arranged on a working ship S and its crane hook H is lowered with the supporting rope underwater. A compensator C hangs on the crane hook, and a shock-sensitive load L is suspended on a downwardly extending piston rod and must be placed gently on a sea bottom. Because of swell which is shown in the drawings, the working ship S is subjected to irregular vibrations which are considerably amplified through the elongated beam of the crane A. Since the cranes of the modern working ships have beams of over 100 meters and the structures with the weight of several hundred tons must be lowered to water depths up to 800 meters and more, even relatively low swell produces high vertical movements of the crane hook H and the load L and superposed onto the intended lowering speed. Since in the event of hard placing of the load L on the sea bottom the structures can be damaged or destroyed, the compensating device C is arranged between the crane hook H and the load L to provide automatic and continuous compensation of the swell-generated relative movements. While the crane hook H or the suspension point of the compensating device C on said hook H is subjected in the positions of the beam indicated in broken lines to high vertical displacements, the load L or its suspension point on the lower end of the piston rod of the compensating device C displaces only insignificantly. As a result of this, undesirable placing shocks of the load L on the sea bottom and violent loading of the crane rope and the beam by abrupt lifts of the load L by swell are avoided.

Figure 2:
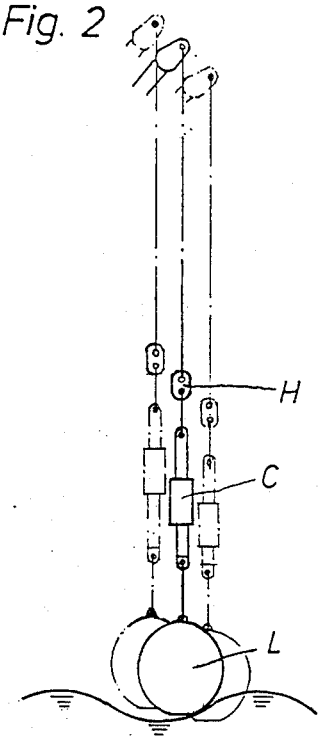
FIG. 2 is a view schematically showing lowering of such a load on a moving water surface.

FIG. 2 shows a difficult situation of immersing the load L into the moving water surface. In contrast to sea bottom, the water surface normally exhibits a relative movement to load L in correspondence with the swell, and the deviations of the crane beam on the working ship S resulted from the swell can be added to the vertical displacements of the water surface. Therefore, deep immersion of the load with respectively great weight loss is followed in the next moment by a complete lifting off the water surface with full weight loading of all supporting elements. Also, the compensating device C provides a continuous compensation of undesirable relative movements.

Figure 3:
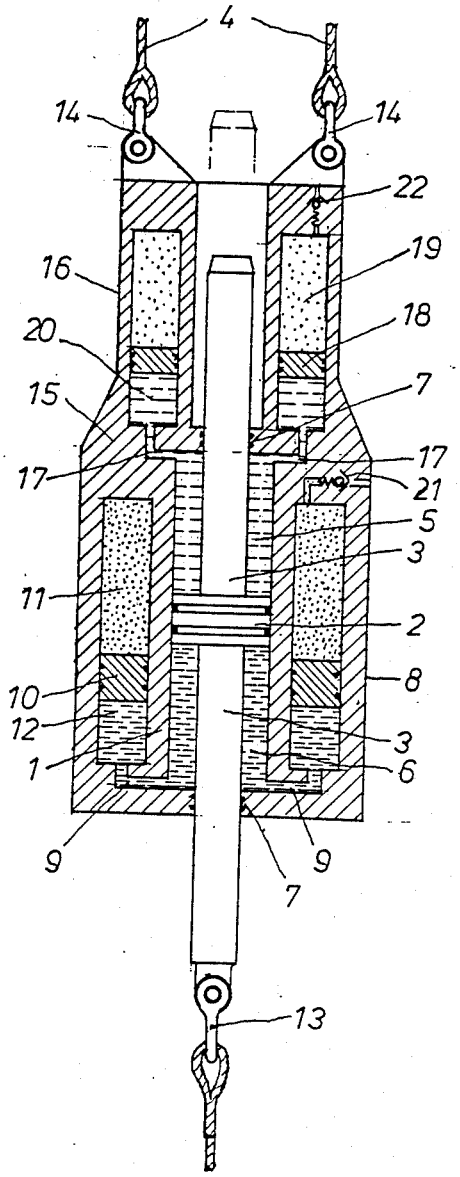
FIG. 3 is a view showing a longitudinal section of a compensating device in accordance with the present invention.

The compensating device shown in FIG. 3 has a central hydraulic cylinder-piston unit with a cylinder 1 which is subdivided by a piston 2 into a load supporting chamber 6 to be filled during operation with hydraulic liquid and a second chamber 5 which is also to be filled with hydraulic liquid during operation. The piston 2 is provided with a piston rod 3 extending in both directions therefrom. The piston rod 3 extends through both chambers 5 and 6 and projects outwardly through axial end walls of the cylinder 1 with interposition of seals 7. In the shown embodiment the portions of the piston which project beyond the cylinder 1 have the same diameter. Thereby during the use of the device under water with water pressure corresponding to the respective water depth, no substantial forces are applied to the piston 2 since the distance between its upper side and its lower side resulting from the structural height of the cylinder-piston unit 1 results only in an insignificant pressure differential. If required, this can be eliminated in that the upwardly extending portion of the piston rod 3 can be formed stronger [thicker] by a value corresponding to this pressure differential. In the inventive device it is not necessary to provide a force compensation corresponding to water pressure which increases with progressing immersion depths to permanently maintain the undisturbed force equilibrium. Naturally, when required a predetermined non-uniform weight can be produced by selection of different diameters of the projecting portions of the piston rod 3 in an intentional manner.

The load supporting chamber 6 communicates via communicating passage 9 with a hydraulic accumulator 8 which concentrically surrounds the cylinder 1. Its ring-shaped inner chamber is subdivided by a displaceable ring-shaped piston 10 into a gas chamber 11 and a liquid chamber 12 which communicates with the load supporting chamber 6. Depending on the weight of a load L which is suspended on the lower end of the piston 3 by means of a supporting ear 13, the gas pressure $P_1$ in the gas chamber 11 is adjusted to such a value that the piston 2 can press the hydraulic liquid accommodated in the load supporting chamber 6 via the communicating passage 9 into the liquid chamber 12 of the hydraulic accumulator 8 to such extent that the piston 2 is located substantially in the center of the cylinder-piston unit 1. The spring constant of this system is derived from the size of the gas chamber 11 and the gas pressure $P_1$ ajusted in it. With sufficiently dimensioned gas chamber, the crane hook H of the working ship S lifted for example by swell, pulls the supporting ears 14 arranged on a housing 15 provided on the upper end of the cylinder-piston unit 1 with higher force without transmitting the same to the piston 2 and to the load L suspended on the piston rod 3 via the supporting ear 13, since the gas cushion accommodated in the gas chamber 11 provides springing action without force increase. By respective dimensioning of the gas chamber 11 with consideration of remaining conditions, it is possible to determine within which limits the load L in condition of predetermined swell takes part in the move-ments of the working ship S transmitted via the crane hook H. It is also necessary to take into consideration that the supporting rope which leads to the crane hook H also has a spring constant which depends on its length and contributes to quieting of the load.

The second chamber of the cylinder 1 is connected via a connecting passage 17 with a hydraulic accumulator 16 which concentrically surrounds the upwardly extending end of the piston rod 3. The ring-shaped inner chamber of the hydraulic accumulator 16 is subdivided by a sealingly displaceable ring-shaped piston 18 into an upper gas chamber 19 and a lower liquid chamber 20. The second chamber 5 of the cylinder 1, the communicating passage 17 and the liquid chamber 20 are completely filled with hydraulic liquid during operation. In this arrangement the hydraulic liquid is displaced in dependence upon the movement of the piston 2 upwardly or downwardly, from the second chamber 5 against the gas pressure into the gas chamber 19, or supplied under the action of the gas pressure in the gas chamber 20 to the second chamber 5.

For preventing disturbance of the above described damping action by transmitting swell-generated relative movements to the load when the load is intentionally or unintentionally placed on a supporting surface and the piston has a tendency to fast movements because of sudden weight unloading, the gas pressure $P_2$ in the gas chamber 19 is adjusted to a value between 0.5 and 50 bar which is considerably lower than the value between 100 and 400 bar of the gas pressure $P_1$ in the gas chamber 11. It is selected so that during a downward movement of the piston 2 the hydraulic liquid is supplied sufficiently fast from the liquid chamber 20, and however the spring constant of the gas chamber 11 which is under high gas pressure $P_1$ is not affected in a disturbing manner when the piston 2 moves downwardly with displacement of the hydraulic liquid into the liquid chamber 20 and respective increase of a gas pressure in the chamber 19. When the gas chamber 19 is dimensioned sufficiently great, only a small pressure increase is produced during its reduction. By respective selection of its size and the height of its gas pressure $P_2$, the gas chamber 19 can brake the upward movement of the piston 2 before reaching the upper end position so that the increased gas pressure $P_2$ in the gas chamber 19 counteracts the downward movement of the piston 2 with increased resistance. Thereby during an unexpected placing of the load L, a dangerously fast upward movement of the piston 2 in the cylinder 1 is prevented which otherwise can lead to damages to the seals 7 and the seals on the piston 2 or to the cylinder 1.

For respectively adjusting the gas pressures $P_1$ and $P_2$ in the gas chambers 11 and 19, they are provided with filling passages and locking valves 21 and 22. Pressure gas can be supplied or withdrawn through these communications in correspondence with the respective requirements. In the embodiment shown in FIG. 3 the ring-shaped hydraulic accumulators 8 and 16 are advantageous since they provide a small diameter with a relatively high length to achieve optimal accumulating capacity. In the embodiment shown in FIG. 4, instead of ring-shaped hydraulic accumulators, individual hydraulic accumulators 23 or 24 are arranged around the cylinder 1 or the upper end of the piston rod 3 extending from the unit. The hydraulic accumulators 24 include a gas chamber 25 and a liquid chamber 12 which is separated from the gas chamber 25 by a displaceable separating piston 26. The liquid chamber 12 communicates via connecting passage 9 with the load supporting chamber 6 of the cylinder 1. The hydraulic accumulator 24 has a liquid chamber 20 which communicates via connecting chamber 17 with the second chamber 5 of the cylinder 1. It also has a gas chamber 27 which is separated by flexible diaphragm 28 formed for example as a rubber bubble or bladder. In the lower end position of the piston 2, the gas which is accommodated in the membrane 28 fills the whole inner chamber of the hydraulic accumulator 24 and closes a disk valve 29 arranged at the inlet of the communicating passage 17 so that the diaphragm 28 is not pressed by the action of the gas pressure $P_2$ into the communicating passage 17.

The hydraulic accumulators 23 are arranged between upper and lower ring-shaped flanges of the cylinder-piston unit 1 at equal distances around its periphery and parallel to the same. They are covered from outside by a cylindrical housing wall 59. Each hydraulic accumulator 23 is pressed against its seat on the ring-shaped flange by a hollow cylindrical pressing piece 30 which is screwed in a threaded opening of the upper ring-shaped flange. Each hydraulic accumulator 23 has a filling valve 31 provided for adjusting the gas pressure $P_1$ in the gas chamber 25 and lying in an inner chamber of the tubular pressing piece 30. The hydraulic accumulators 24 are arranged in respective manner by means of the pressing pieces 30 between the ring-shaped flanges of a pipe projecting upwardly from the cylinder and enclosed outwardly by a housing wall. Each filling valve 31 is accessible via the opening of the tubular pressing piece 30.

Figure 4:
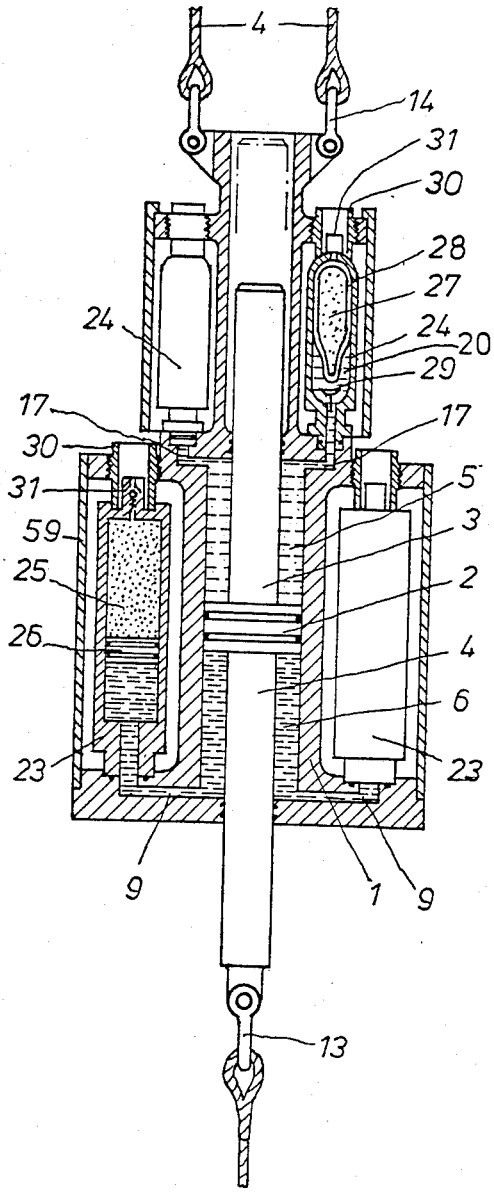
FIG. 4 is a view showing a longitudinal section of the compensating device in accordance with another embodiment of the invention.

The compensating device shown in FIG. 4 is simple to manufacture and can be adjusted for handling various heavy loads in a more flexible way. The reason is that it is not necessary to adjust individually the gas pressure of each hydraulic accumulator 23 or 24, but instead this can be achieved by filling selected hydraulic accumulator with especially high gas pressure so that these contribute only in extreme cases or not at all to the movement damping. Thereby the size of gas chambers generally acting for movement damping can be changed in a simple manner.

In the embodiment shown in FIGS. 3 and 4 the piston rod 3 extends upwardly and downwardly with consideration of the required extension length to provide a short structure which is advantageous for cranes with relatively small crane hook height.

Figure 5:
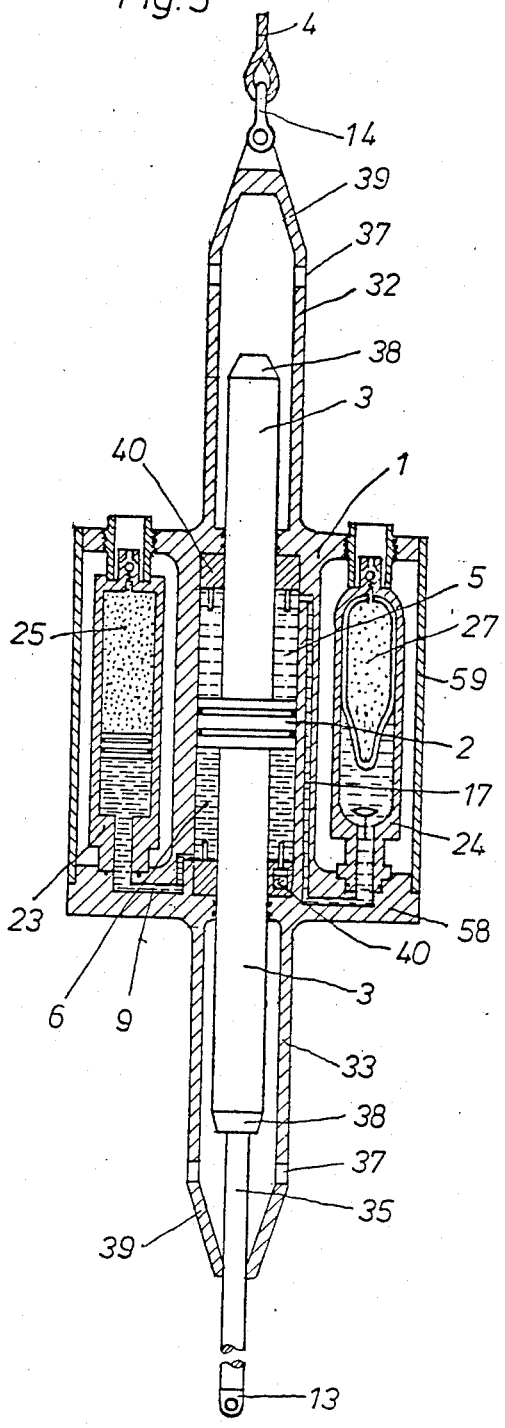
FIG. 5 is a view schematically showing a longitudinal section of the compensating device in accordance with a further embodiment of the invention.

The compensating device of FIG. 5 with a longer structure is formed so that the hydraulic accumulators communicating via the communicating passage with the load supporting chamber 6, and the hydraulic accumulator 4 communicating via the communicating passage 17 with the second chamber 5 of the cylinder 1 are arranged alternatingly on a common circular line around the cylinder 1. The individual hydraulic accumulators can be provided with separating pistons which separate the gas chamber 25 or with diaphragms which separate the gas chamber 27, in correspondence with the respective requirements. This embodiment is very compact and effective, however the accumulating volumes and thereby the load to be handled are limited.

In this embodiment, on the end surfaces of the cylinder 1, the projecting ends of the piston rod 3 are concentrically surrounded by tubes 32 and 33. The tube 32 is closed at its upper end and carries a supporting ear 14 for the crane rope 4. The lower tube 33 is provided at its lower end with a through opening for an extension rod 35 connected with the piston rod 40. At its lower end it has a supporting ear 13 for mounting of the load. Both tubes 32 and 33 have lateral through-going openings 37 for discharging water displaced during underwater works by the extending piston rod 3, or the inflow of water during retracting of the piston rod 3. The tubes 32 and 33 are provided with conically narrowing end portions 39, and the piston rod is provided at its ends with conical portions 38. The conical portions 38 during extension of the piston rod 3 after passing the through-going openings 37 penetrate into the conically reducing end portions 39 of the respective tubes 32 and 33 and the water located therein is pressed via a continuously narrowing annular gap to the through-going openings 37. This provides a damping water pressure during extension of the piston rod 3 and therefore prevents a hard abutment of the piston 2 against the end surface of the cylinder 1.

In the shown embodiment the load supporting chamber 6 and the second chamber 5 of the cylinder-piston unit 1 is associated with an additional impact damping unit 40 located near its end walls. The impact damping unit 40 advantageously has a piston which is sealingly displaceable in a cylinder and provided with an upwardly extending plunger. The plunger can be displaced back by the piston 2 against a gas cushion which is highly pretensioned and accommodated in the impact damping unit 40. Depending upon the requirements, the impact damping units can be formed differently, to provide a sufficient impact damping and at the same time to occupy a small space.

With this compensating device it is possible to lower also very heavy hollow bodies which during immersion under water weighs only small fraction of its weight above water because of their buoyancy, without special regulating measures as to the volume or the pressure of the hydraulic accumulator. As long as the hollow body hangs above water on the crane hook H, the piston 2 in the cylinder-piston unit 1 practically lies completely on the impact damping unit 40 and presses its plunger. As soon as the hollow body is placed on the water surface, it is lighter than when it is in water moved by swell. The piston 2 is pressed outwardly under the action of the impact damping unit 40 and the hydraulic accumulator connected with the load supporting chamber 6. When during the next wave trough the hollow body is again completely or continuously removed from water and its weight is suddenly considerably increased, the forced downward movement of the piston 2 by the joint action of the impact damping unit 40 and the water impact in conically reduced end portion 39 of the lower tube 33 is absorbed so that a hard impact of the piston 2 with destructive action is avoided. This design provides simultaneously a sufficient protection against unpredictable high individual dual waves are against oncoming high swells during long work periods under water. The impact damping unit 40 can be provided advantageously with not-shown conventional devices for adapting the pretensioning pressure, for adapting to the requirements of each individual location.

When the hollow body is completely immersed in water, the piston 2 is pressed upwardly to a central position in the cylinder 1 by the gas pressure in the hydraulic accumulators 23 adjusted preliminarily to the respective reduced weight. During further progress of lowering by means of the crane, the piston 2 and the load L swings only insignificantly about its central position.

Figure 6:
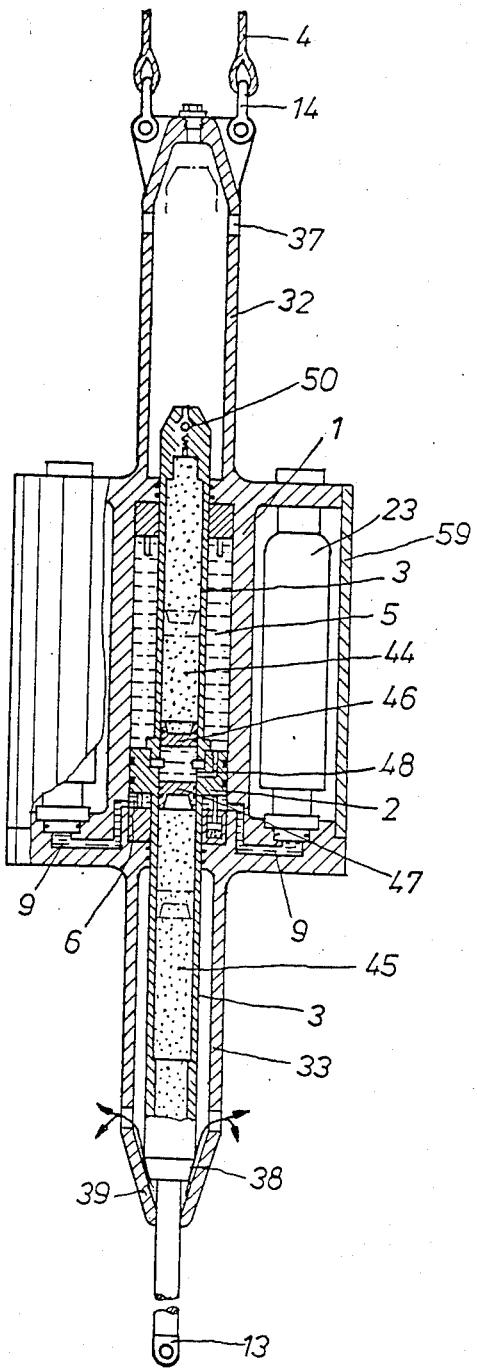
FIG. 6 is a view schematically showing the compensating device in accordance with still a further embodiment of the invention.

The advantageous embodiment shown in FIG. 6 is similar to the embodiment of FIG. 5. However, it is provided with a hydraulic accumulator which communicates with the second chamber 5 and is located in the interior of the hollow piston rod 3. Such a solution not only is space-economical, but also is favorable in the sense of its efficiency since several hydraulic accumulators surrounding the cylinder can be saved, or the total volumes of the gas chambers available for damping can be respectively increased.

In the shown embodiment, the hollow piston rod 3 has two gas chambers 44 and 45 separated by a central liquid chamber. The liquid chamber communicates via a connecting passage 48 with the second chamber 5 of the cylinder 1. Only the hydraulic accumulators 23 communicating with the load supporting chamber 6 can be provided around the cylinder 1, so as to provide an optimal accumulating volume without increasing the diameter of the total device.

Filling valves 50 for filling the gas chambers 44 and 48 are arranged at the end of the piston rod 3. In FIG. 6 the piston 2 is located approximately in its lowest end position in the cylinder 1. The lower end of the piston rod 3 projects with its conical portion 38 deeply into the conically narrowing end portions 39 of the tube. Thereby the displacement of water which is enclosed in the conically reducing end portion 39 through the remaining small ring-shaped gap during small extension movement of the piston rod 3 is performed with a braking dynamic action.

Figure 7:
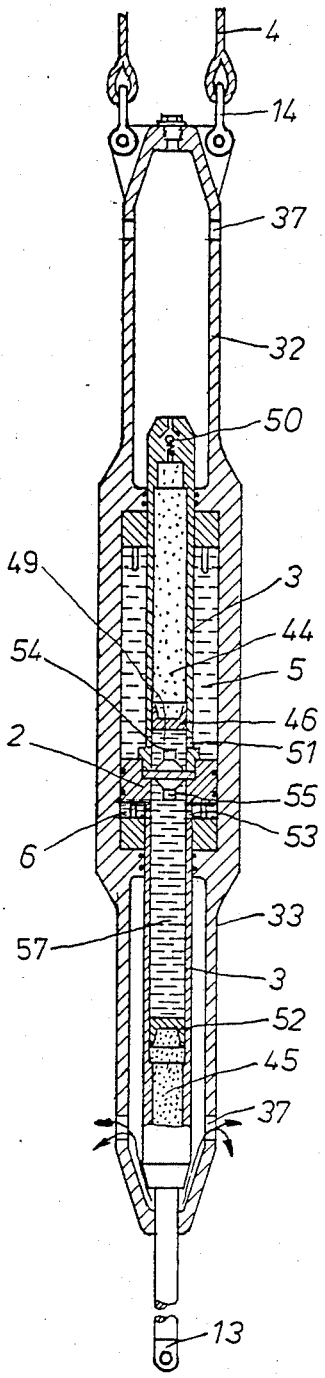
FIG. 7 is a view showing a longitudinal section of a compensating device.

In the embodiment shown in FIG. 7 a liquid chamber 49 which is separated from the gas chamber 44 by a separating piston 46 communicates via communicating openings 51 with the second chamber 5 of the cylinder. A liquid chamber 57 which is separated by a separating piston 52 from the gas chamber 45 in the lower part of the hollow piston rod 3 communicates via communicating openings 53 with the load supporting chamber 6 of the cylinder 1. The gas chamber 45 is filled with gas which is pretensioned with a higher gas pressure $P_1$, while the gas chamber 44 has a lower gas pressure $P_2$. For limiting the movement of the separating pistons 46 and 52, abutments 54 and 55 are provided in the region of the piston 2. In the lower end position of the piston 2, the separating piston 46 can travel at most to the position of abutment against the abutment 54, in which the liquid accommodated in the chamber 5 is pressureless, while the gas cushion accommodated in the gas chamber 45 abuts via the separating piston 46 against the abutment 54. In a reversed situation, in the upper end position of the piston 2 the separating piston 52 can travel at most until its abut against the abutment 55, while the gas pressure in the gas chamber 45 is absorbed via the separating piston 52 and the abutment 55. In practice, however, the load supporting chamber 5 and the second chamber 6 are filled with excessive quantities of hydraulic liquid, so that the separating pistons 46 and 52 do not abut against the respective abutments 54 and 55 in the end positions of the piston 2. This has the advantage that the separating pistons do not abut against the respective abutments prematurely in the event of leakage losses, whereby in the load supporting chamber 5 or in the second chamber a vacuum can form when the piston 2 has covered a further path without pressing of the hydraulic liquid by the gas. Because of this, in the event of a leakage the operation can continue without repair interruptions.

The compensating device of the embodiment in FIG. 7 has a slim construction which is robust against mechanical damages, and at the same time is effective and manufacturing-favorable. This is true especially when the diameter of the piston rod 3 and the hydraulic accumulator accommodated in it can be dimensioned sufficiently high for obtaining greater gas chambers 44 and 45, or the reaction of the loads to be carried or the desired reduction of the relative movements are not very high.

In the preceding embodiments the compensating device is designed so that during its use without additional measures on working ship, different working conditions including unpredictable deviation therefrom cannot be taken care of. As a result, very simple handling and a minimum monitoring and service are required. For monitoring, color marks can be provided for example on the extension rod 35 projecting from the lower tube 33, to provide the information about the position and the path of the piston 2 in the cylinder 1 and respective movements of the load L. During works underwater, this can be performed by a respective underwater camera. Instead, the relative position of the extension rod 35 to the lower end of the tube 33 can be detected by a suitable sensor and signaled by known means to the crane or working ship. Moreover, it is also possible with low expenses to use these signals from the crane or ship for operating the compensating device.

Figure 8:
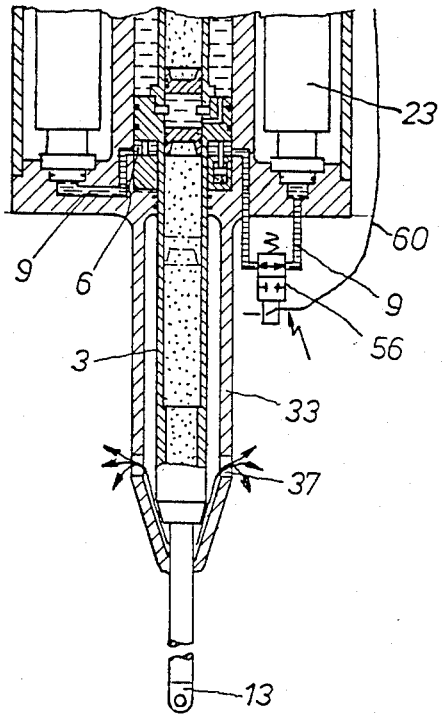
FIG. 8 is a partial view of the compensating device of FIG. 6, with additional blocking means.

In the compensating device in accordance with the different embodiment shown in FIG. 8, the connecting passage which leads from the load supporting chamber 6 to the hydraulic accumulator 23 is provided with a remotely actuated blocking valve 56. It is controlled via a control conduit 60 or a not-shown remotely radio-actuated adjusting device. The blocking valve 56 can be provided in the communicating passage 9 or 17 of each hydraulic accumulator 23 or 24. In this manner in the use under water or above water, the number of active hydraulic accumulators can be adjusted to changing work or load conditions and desired damping value.

The above described embodiments can be modified by a skilled person in corresponding with the respective requirements, as long as the two-side action of the piston 2 displaceable in the cylinder 1 is obtained by hydraulic liquid cooperating with hydraulic accumulators. When for the device provided only for the use under water the utilization of a piston rod with two projecting ends is dispensed with, still a considerably improved operational safety is achieved against abrupt load changes during placing of suspended load or sudden lifting thereof.

It will be understood that each of the elements described above, or two or more together, may also find a useful application in other types of constructions differing from the types described above.

While the invention has been illustrated and described as embodied in a compensating device, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. A compensating device for reducing swell-generated relative movements between a load suspended on a crane, and a load placing surface or a crane hook the compensating device comprising a hydraulic cylinder-piston unit including a cylinder having end walls and an inner space, a piston sealingly displaceable in said cylinder and subdividing said inner space into a load supporting chamber to be filled in operation with hydraulic liquid, and a second chamber to be filled in operation with hydraulic liquid, a piston rod connected with said piston and extending through both said load supporting chamber and said second chamber sealingly outwardly through both end walls of said cylinder, at least one hydraulic accumulator connected with said load supporting chamber and adapted to accommodate a pretensioned gas cushion, and at least one other hydraulic accumulator connected with said second chamber and adapted to accommodate a gas cushion pretensioned to a lower pressure.

2. A device as defined in claim 1; and further comprising a ring-shaped cylindrical element which surrounds said cylinder, and a ring-shaped piston which is sealingly displaceable in said ring-shaped cylindrical element to subdivide the latter into a ring-shaped liquid chamber communicating with said load supporting chamber, and a ring-shaped gas chamber.

3. A device as defined in claim 1, wherein said hydraulic accumulator connected with said second chamber includes a ring-shaped cylindrical element mounted to said cylinder and concentrically surrounding said piston rod, and a ring-shaped piston displaceable sealingly in said ring-shaped cylindrical element for subdividing the latter into a ring-shaped gas chamber and a ring-shaped liquid chamber.

4. A device as defined in claim 1, wherein at least one of said hydraulic accumulators includes a plurality of hydraulic accumulating elements having predetermined individual values.

5. A device as defined in claim 4; and further comprising a housing which is concentrical to said cylinder and surrounds said hydraulic accumulating elements which are peripherally distributed in said housing.

6. A device as defined in claim 5, wherein said hydraulic accumulators include a plurality of hydraulic accumulating elements arranged side-by-side in peripheral direction of said housing; and further comprising two communicating passages formed so that one of said communicating passages communicates one or more of said hydraulic accumulating elements with said load supporting chamber, while the other of said communicating passages communicates the other of said hydraulic accumulating elements with said second chamber.

7. A device as defined in claim 1, wherein said piston rod is hollow and has an inner hollow space, said hydraulic accumulator connected with said load supporting chamber or said second chamber including at least one hydraulic accumulating element accommodated in said inner space of said piston rod.

8. A device as defined in claim 7, wherein said hydraulic accumulator has a plurality of hydraulic accumulating elements arranged in said inner space and each provided with a displaceable piston which separates a gas chamber in a respective one of said hydraulic accumulating elements.

9. A device as defined in claim 1, wherein said hydraulic accumulating element has a gas chamber; and further comprising means for adjusting gas pressure in said gas chamber.

10. A device as defined in claim 1, wherein said hydraulic accumulator has a plurality of hydraulic accumulating elements; and further comprising blocking means arranged so that at least one of said hydraulic accumulating elements is connected with a respective one of said chambers via said blocking means.

11. A device as defined in claim 10, wherein said blocking means is formed as remotely-actuatable blocking means.

12. A device as defined in claim 1, wherein said cylinder has end walls; and further comprising impact damping means provided in at least one of said chambers for preventing a hard impact of said piston against one of said end walls of said cylinder.

13. A device as defined in claim 12, wherein said impact damping means is formed so that its yieldability is adjustable.

14. A device as defined in claim 1, wherein said piston rod is extendable from said cylinder; and further comprising means for damping extension movement of said piston rod.

15. A device as defined in claim 14, wherein said extension movement damping means includes two tubes which are arranged on said cylinder and concentrically surround said piston rod during its extension.

16. A device as defined in claim 15, wherein one of said tubes has an end with an opening, said piston rod having an end extending through said end opening of said one tube and provided with means for connecting to a load or a crane hook, the other of said tubes also having an end which is closed and provided with lateral through openings.

17. A device as defined in claim 16, wherein both of said tubes are provided with said lateral through openings and have conically reducing end portions, said piston rod having a conical end portion which during extension of said piston rod under water moves into said conical end portions of said tubes and provides an extension dampening water because of a narrowing gap.

18. A device as defined in claim 15, wherein said end of said other tube is provided with means for connecting with a crane hook or a load.

* * * * *